US007347216B2

(12) United States Patent
Chuang

(10) Patent No.: US 7,347,216 B2
(45) Date of Patent: Mar. 25, 2008

(54) TENT FOR USE WITH BICYCLE

(76) Inventor: Louis Chuang, 2F-2, No. 91, Section 4 Mei Chuan East Road, Pei Tun District, Taichung (TW)

( * ) Notice: Subject to any disclaimer, the term of this patent is extended or adjusted under 35 U.S.C. 154(b) by 577 days.

(21) Appl. No.: 10/858,932

(22) Filed: Jun. 2, 2004

(65) Prior Publication Data

US 2005/0139247 A1 Jun. 30, 2005

(30) Foreign Application Priority Data

Dec. 31, 2003 (TW) ..... 92137820 A
Feb. 13, 2004 (TW) ..... 93103429 A

(51) Int. Cl.
*E04H 15/06* (2006.01)

(52) U.S. Cl. ..... 135/88.13; 135/88.01; 135/88.03; 135/88.04; 135/88.06; 135/88.15

(58) Field of Classification Search ..... 135/88.01, 135/88.03, 88.04, 88.06, 88.15, 88.17, 87, 135/88.13, 97, 120.4, 905; 150/167; 280/288.4
See application file for complete search history.

(56) References Cited

U.S. PATENT DOCUMENTS 527,549 A * 10/1894 Frankenberg ..... 135/88.13
3,913,968 A * 10/1975 Luppens ..... 296/161
4,114,633 A * 9/1978 Herbez ..... 135/97
5,042,795 A * 8/1991 Bursik ..... 482/61
5,313,972 A * 5/1994 Goldberg ..... 135/88.01
5,372,156 A * 12/1994 Kern ..... 135/88.03

FOREIGN PATENT DOCUMENTS

EP 139070 A2 * 5/1985
GB 2221933 A * 2/1990
GB 2228500 A * 8/1990

* cited by examiner

*Primary Examiner*—David Dunn
*Assistant Examiner*—Danielle Jackson
(74) *Attorney, Agent, or Firm*—Alan Kamrath; Kamrath & Associates PA

(57) ABSTRACT

A tent is provided for use with a bicycle. The bicycle includes a handle bar, a front fork and a front wheel. The tent includes a cloth and a connecting device. The cloth includes a first end that can be supported on the handle bar and secured to the ground and a second end that can be supported on the front wheel detached from the front fork and secured to the ground. The connecting device is used for stable installment of the front fork on the ground.

22 Claims, 9 Drawing Sheets

TENT FOR USE WITH BICYCLE

FIELD OF INVENTION

The present invention relates to a tent for use with a bicycle.

BACKGROUND OF INVENTION

A tent is used for camping. A tent includes a cloth, several poles for supporting the cloth, several ropes for pulling the cloth and the poles and several pegs for nailing the ropes to the ground. It takes considerable time to assemble such a tent because it includes many components. In addition, such a tent is inconvenient for a bicycle rider in a long journey in the wild. It is inconvenient for a bicycle rider to carry such a tent because it is heavy and bulky even when it is packed. Furthermore, it is difficult to the bicycle rider to take care of his bicycle because the bicycle is separate from such a tent. Thus, the bicycle can easily be stolen while the bicycle rider is sleeping.

The present invention is therefore intended to obviate or at least alleviate the problems encountered in the prior art.

SUMMARY OF INVENTION

The primary objective of the present invention is to provide a structurally simple tent for use with a bicycle.

According to the present invention, a tent is provided for use with a bicycle. The bicycle includes a handle bar, a front fork and a front wheel. The tent includes a cloth and a connecting device. The cloth includes a first end that can be supported on the handle bar and secured to the ground and a second end that can be supported on the front wheel detached from the front fork and secured to the ground. The connecting device is used for stable installment of the front fork on the ground.

Other objectives, advantages, and novel features of the invention will become more apparent from the following detailed description when taken in conjunction with the attached drawings.

BRIEF DESCRIPTION OF DRAWINGS

The present invention will be described through detailed illustration of two embodiments referring to the drawings.

DETAILED DESCRIPTION OF EMBODIMENTS

Figure 1:
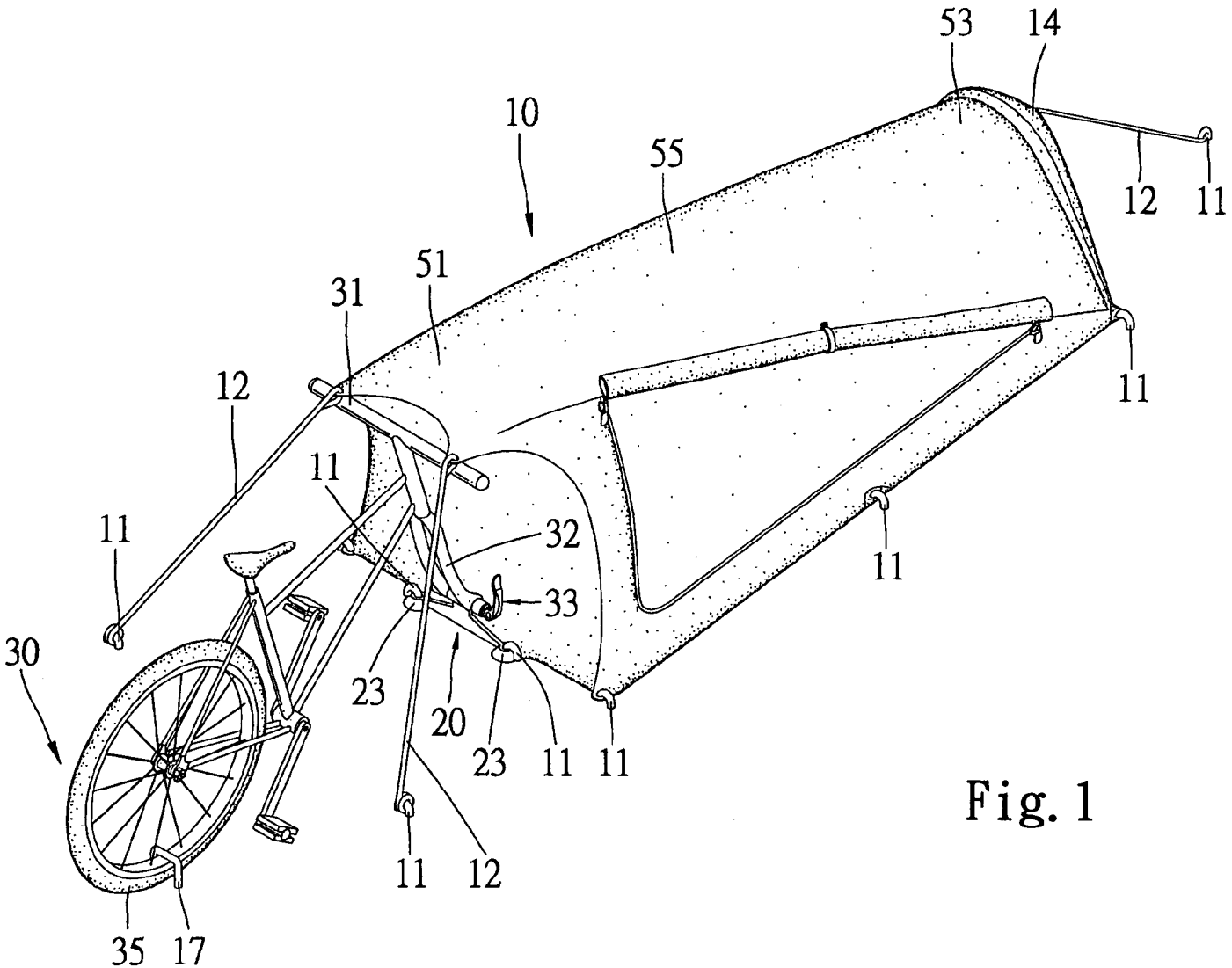
FIG. 1 is a perspective view of a tent according to a first embodiment of the present invention.
Figure 2:
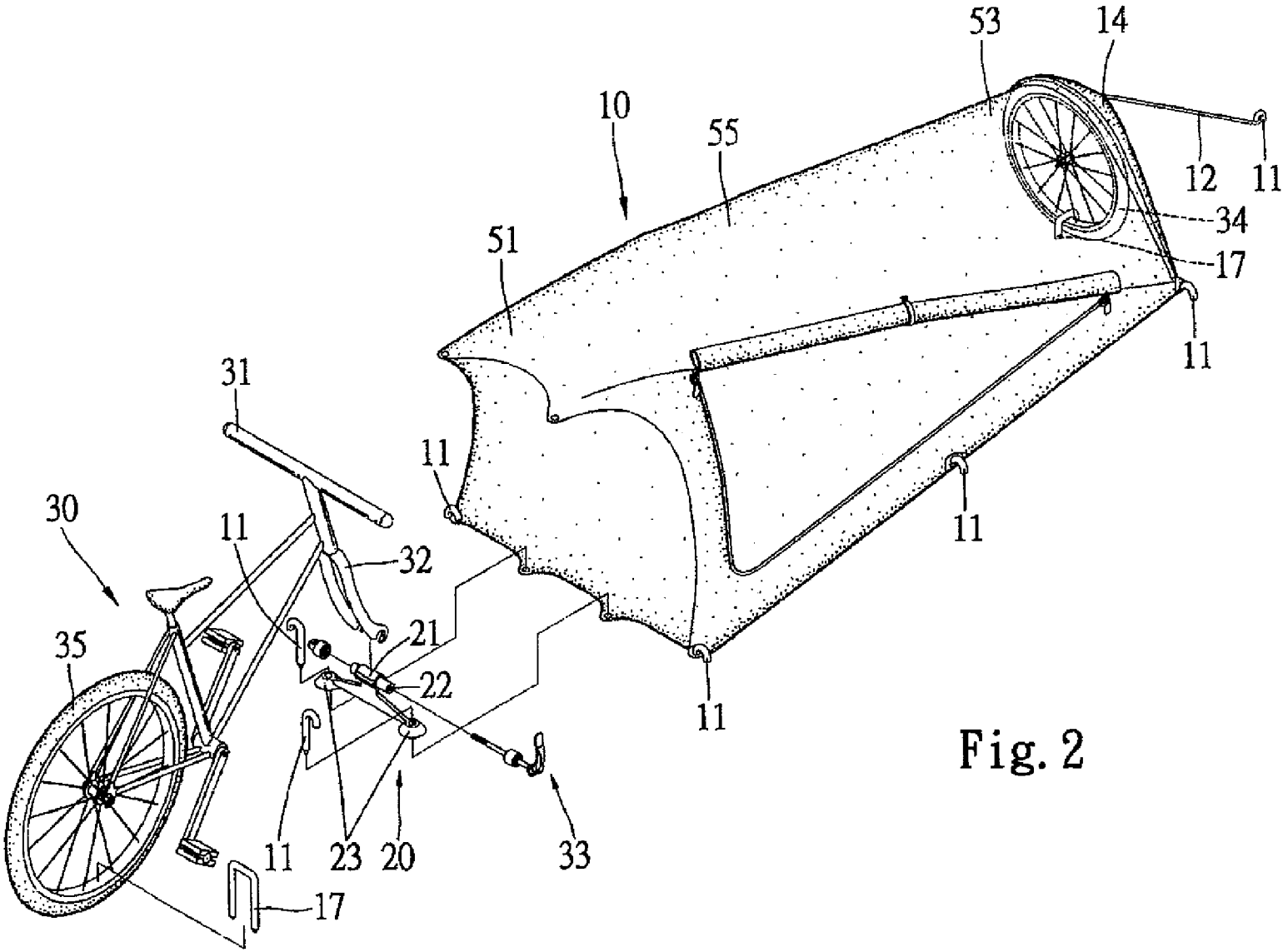
FIG. 2 is an exploded view of the tent of FIG. 1.
Figure 3:
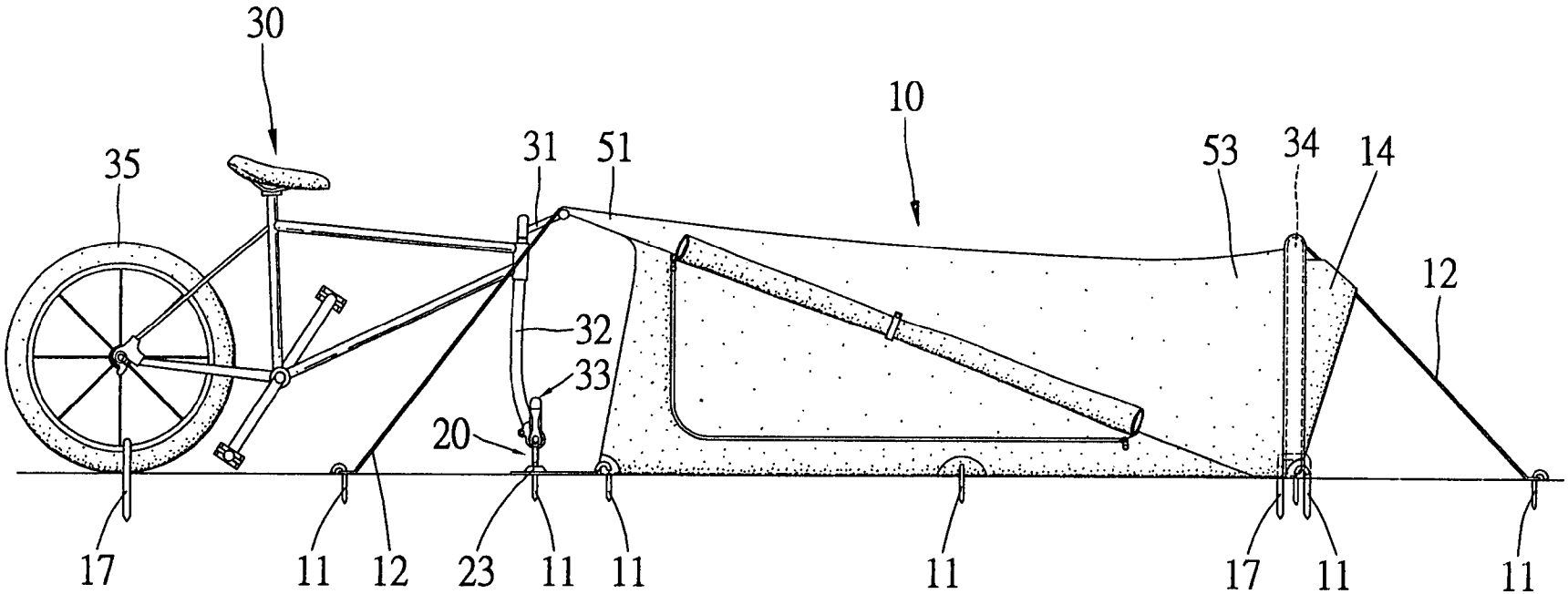
FIG. 3 is a side view of the tent of FIG. 1.

FIGS. 1 to 3 show a tent 10 according to a first embodiment of the present invention for use with a typical bicycle 30. The bicycle 30 will be described briefly before the tent 10 is described in detail.

The bicycle 30 includes a handle bar 31, a front fork 32 controlled by the handle bar 31, a front wheel 34 detachably attached to the front fork 32 by a quick-release device 33 and a rear wheel 35.

The tent 10 includes a cloth 55, a connecting device 20 and a bicycle 30. The cloth 55 includes a first end 51 and a second end 53. The first end 51 is supported by the handlebar 31. The first end 51 includes an upper portion and a lower portion. An end of each of two ropes 12 is tied to the upper portion of the first end 51 and the other end of the rope 12 is secured to the ground by a peg 11. The lower portion of the first end 51 is secured to the ground by two pegs 11.

The connecting device 20 includes a pseudo shaft 21 formed on an upper portion and two pads 23 formed on a lower portion. The front fork 32 is supported on the pseudo shaft 21 used like the shaft of the front wheel 34. The quick-release device 33 can be inserted through a hole 22 defined in the pseudo shaft 21 in order to retain the front fork 32 on the pseudo shaft 21. The pads 23 are used for stable installment on the ground. A peg 11 is used to secure each pad 23 and the lower portion of the first end 51 to the ground.

The rear wheel 35 is secured to the ground by an inverted U-shaped peg 17.

Figure 4:
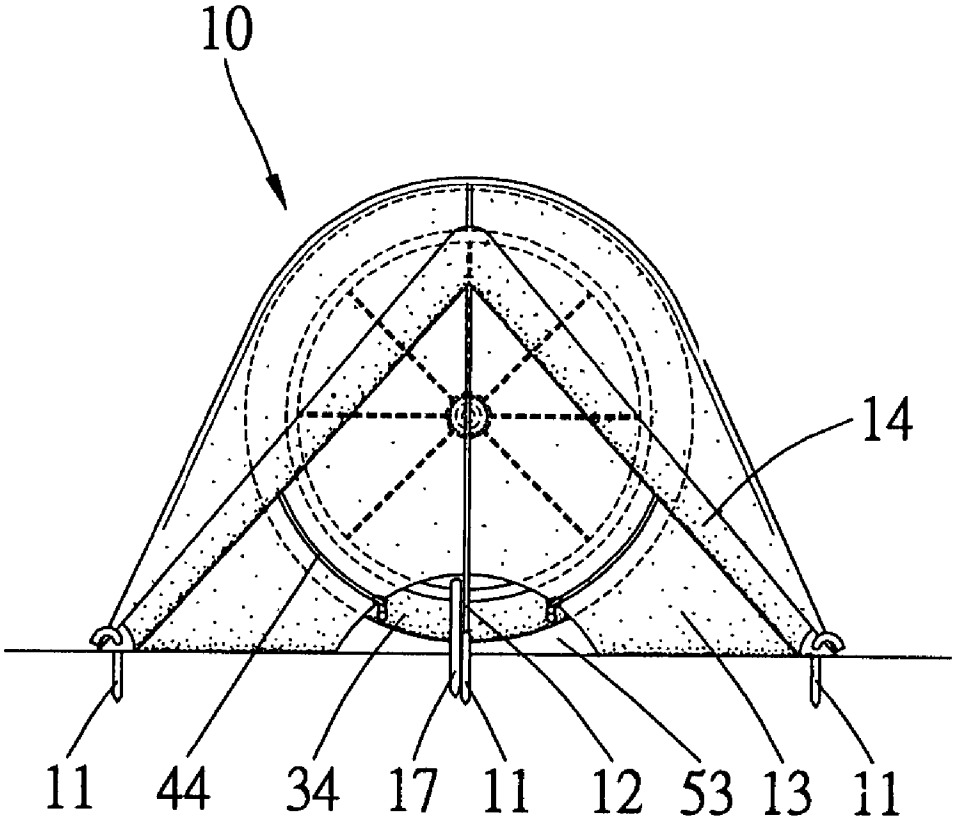
FIG. 4 is a front view of the tent of FIG. 3.

Referring to FIG. 4, the cloth 55 includes a cover 13 extending from the second end 53 and an auxiliary element 14 extending from the cover 13. The front wheel 34 is put between the second end 53 and the cover 13. Two zippers 44 are provided on the cover 13 for retaining the front wheel 34 between the second end 53 and the cover 13. A lower portion of the second end 53 is secured to the ground by means of two pegs 11. An end of a rope 12 is tied to the auxiliary element 14, and an opposite end of this rope 12 is secured to the ground by a peg 11.

The cloth 55 includes two sides each including a center portion which is secured to the ground by a peg 11.

Figure 5:
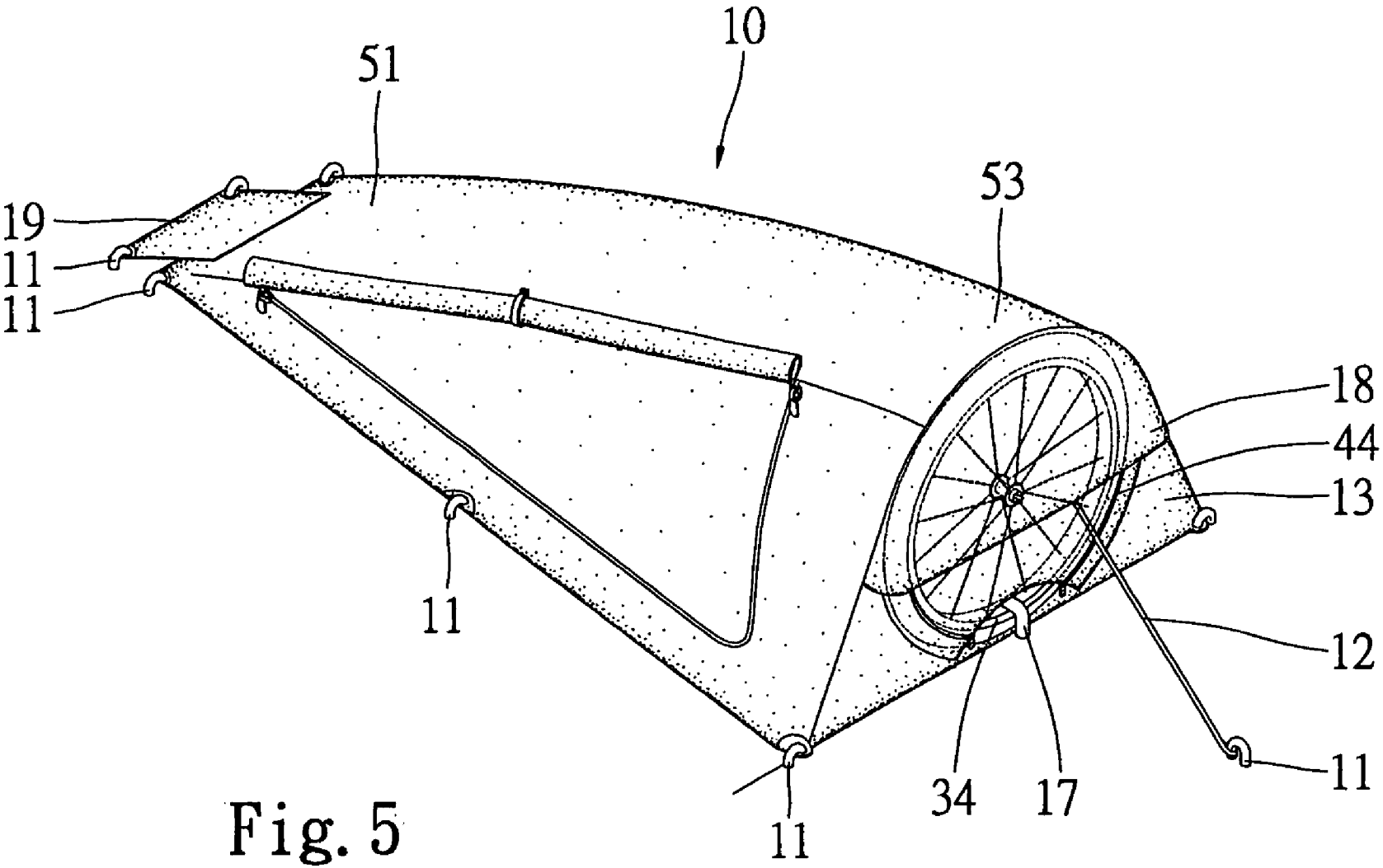
FIG. 5 is a perspective view of a tent according to a second embodiment of the present invention.
Figure 6:
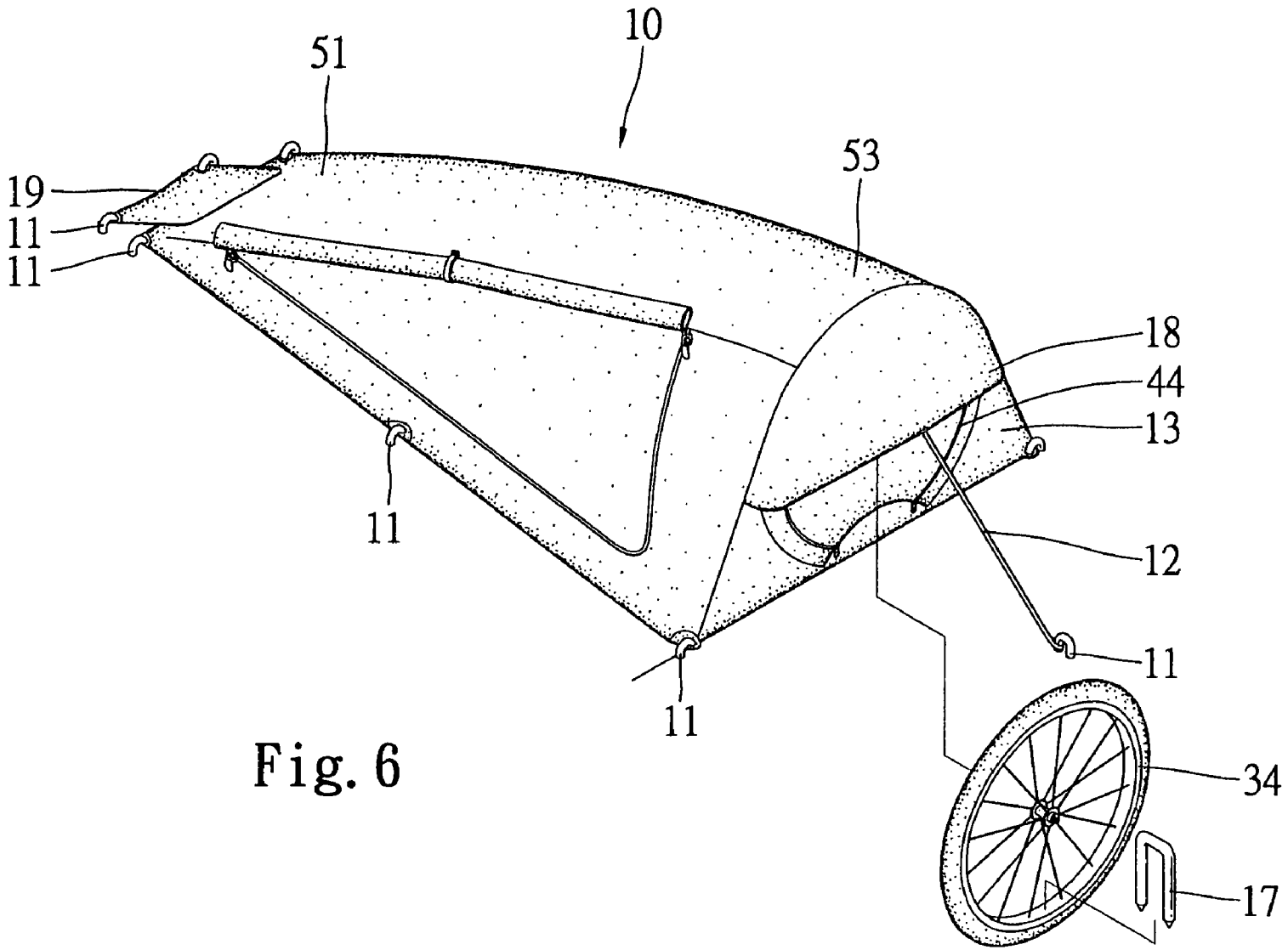
FIG. 6 is an exploded view of the tent of FIG. 5.
Figure 7:
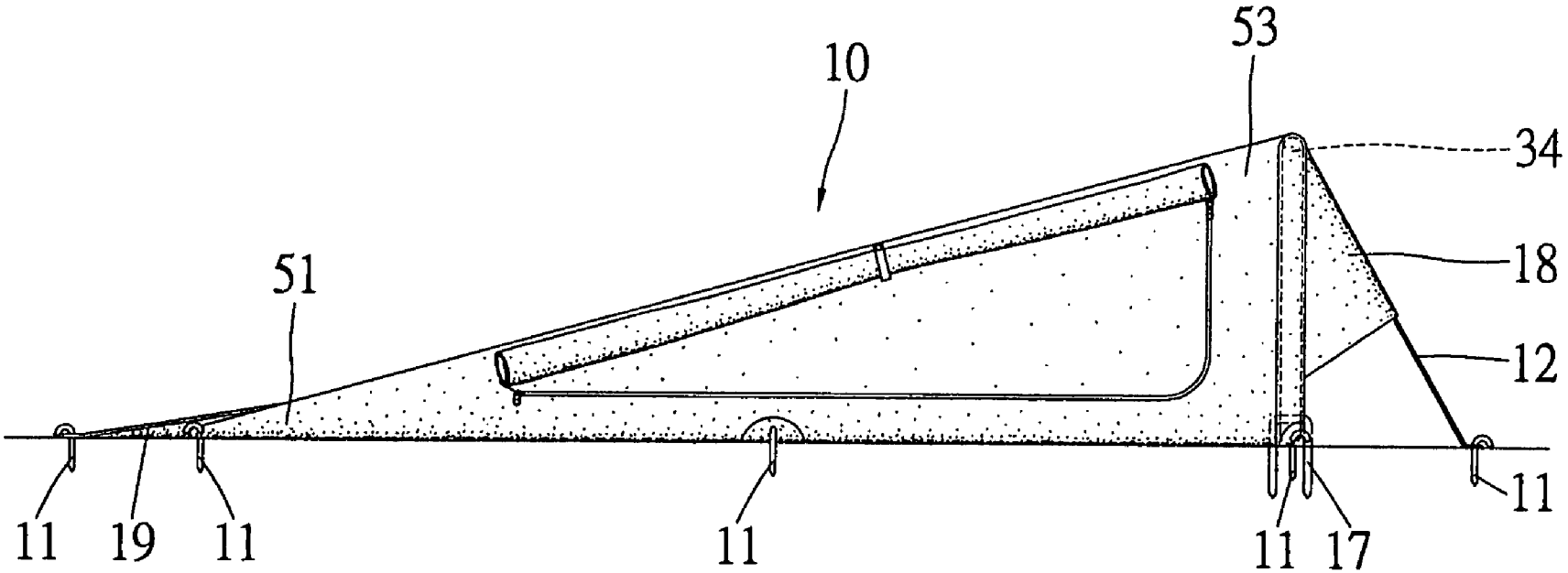
FIG. 7 is a side view of the tent of FIG. 5.

FIGS. 5 to 7 show a tent according to a second embodiment of the present invention. The second embodiment is identical to the first embodiment except for two points. Firstly, the first end 51 is secured to the ground directly instead of supported on the handle bar 31. Thus, the connecting device 20 is saved. Secondly, an auxiliary element 19 that extends from the first end 51 is secured to the ground by two pegs 11. Thirdly, instead of the arched auxiliary element 14, a semi-circular auxiliary element 18 extends from the second end 53.

Figure 8:
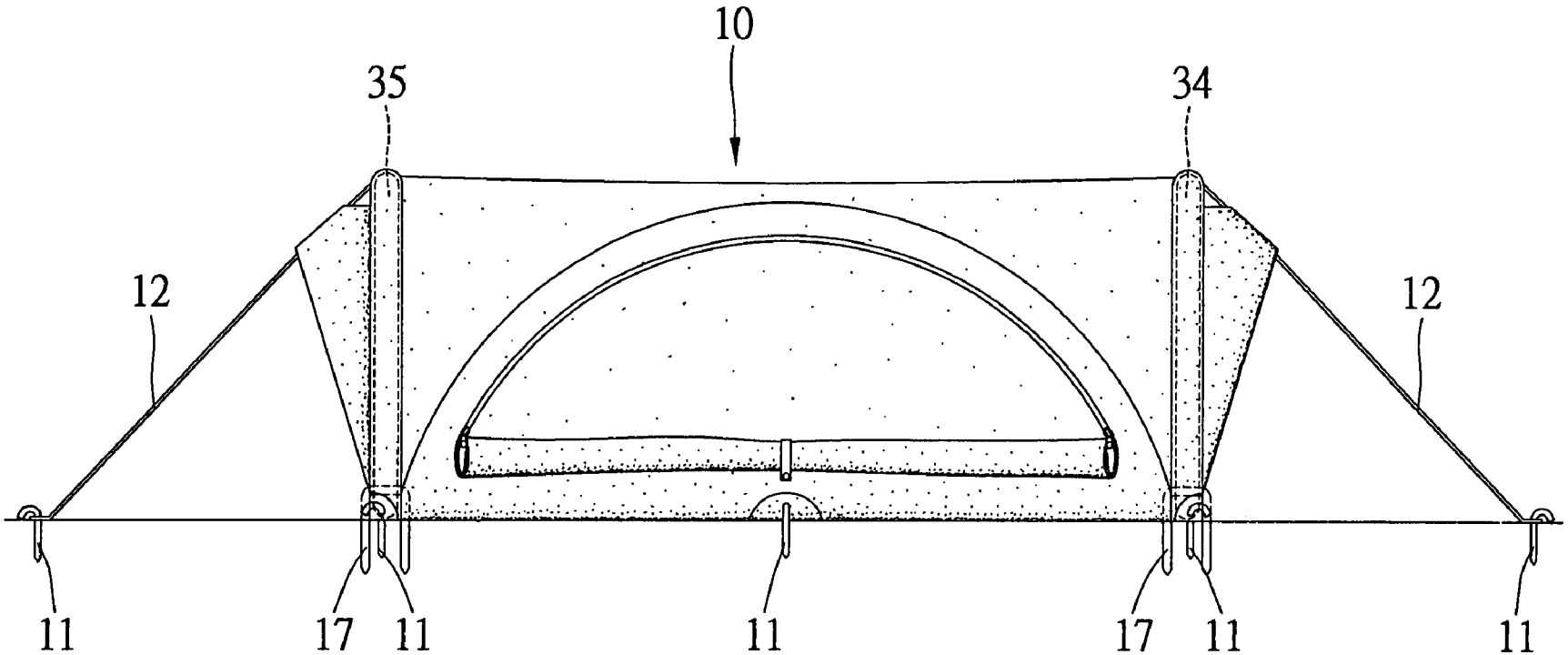
FIG. 8 is a side view of a tent according to a third embodiment of the present invention.

FIG. 8 shows a tent according to a third embodiment of the present invention. The third embodiment is identical to the first embodiment except that the first end is supported on the rear wheel 35 instead of the handle bar 31. To this end, a cover 13 and an auxiliary element 14 are formed at the first end 51.

Figure 9:
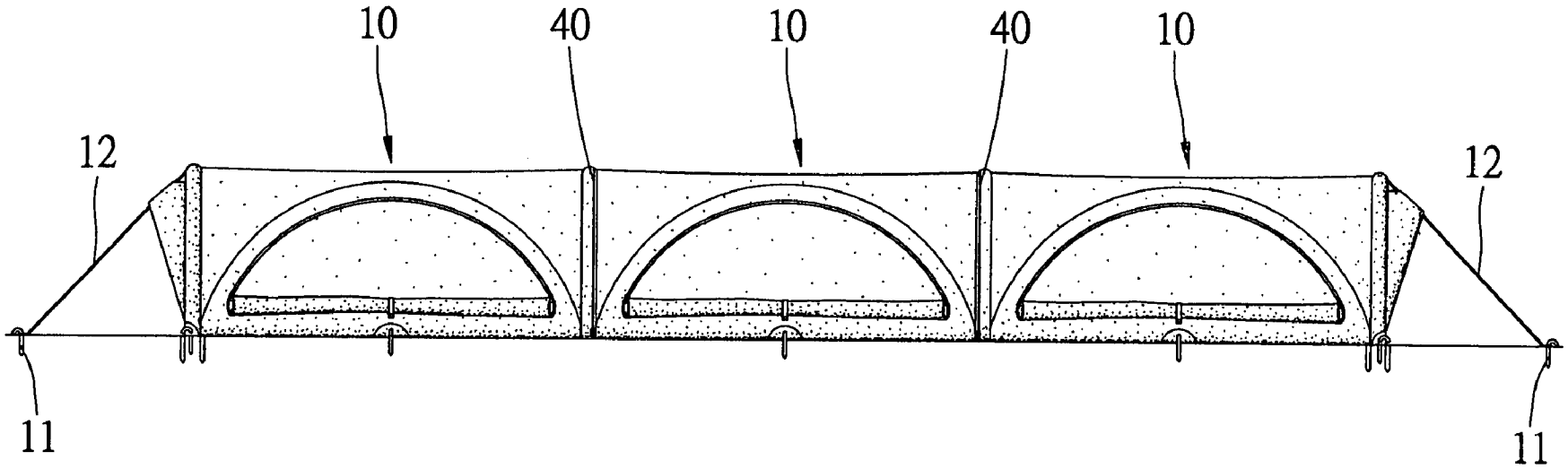
FIG. 9 is a side view of a tent according to a fourth embodiment of the present invention.

FIG. 9 shows a tent according to a fourth embodiment of the present invention. The fourth embodiment is identical to the third embodiment except that the cloth 55 includes several portions that are made separately and connected with one another zippers 40.

The present invention has been described through detailed illustration of the embodiments. Those skilled in the art can derive variation from the embodiments without departing from the scope of the present invention. Therefore, the embodiments shall not limit the scope of the present invention defined in the claims.

The invention claimed is:

1. Combination comprising: a tent and a bicycle moveable on ground, with the bicycle comprising:

a handle bar;

a front fork attached to the handle bar;

a front wheel removably received in the front fork and opposite to the handle bar, with the tent comprising:

a cloth having a first end and a second end, with the first end of the cloth supported by the handle bar and secured to the ground, wherein the second end of the cloth is supported on the front wheel while the front wheel is detached and spaced from the front fork and secured to the ground; and at least one rope having a first end tying the first end of the cloth to the handle bar and a second end secured to the ground.

2. The combination according to claim 1 wherein the cloth comprises a cover extending from the second end, with the spaced and detached front wheel located between the second end and the cover.

3. The combination according to claim 2 comprising at least one zipper connecting the second end of the cloth with the cover.

4. The combination according to claim 2 wherein the cloth comprises an auxiliary element extending from the cover, with the auxiliary element connected to the ground.

5. The combination according to claim 1 wherein the cloth comprises an auxiliary element extending from the second end of the cloth, with the auxiliary element connected to the ground by the at least one rope.

6. The combination according to claim 1 further comprising a connecting device installed on the front fork while the front wheel is detached to stabilize the front fork in relation to the ground to hold the handle bar and the first end of the cloth supported by the handle bar spaced from the ground, wherein the front wheel has an axle, wherein the front fork further comprises a lower portion and an opening located on the lower portion, with the axle being received in the opening on the lower portion, with the connecting device including a pseudo shaft removeably received in the opening on the lower portion.

7. A tent for use with a bicycle moveable on ground, the bicycle including a handle bar and a front fork attached to the handle bar, with the tent comprising:

a connecting device to stabilize the installment of the front fork of the bicycle on the ground after removing a front wheel from the front fork, wherein the connecting device comprises a pseudo shaft adapted to be received by the front fork to support the front fork after the front wheel has been removed from the front fork, with the connecting device further comprising a stabilizing member for securing the pseudo shaft to the ground in a fixed, horizontal and parallel position relative to the ground when the pseudo shaft is removably received by the front fork; and a cloth having a first end and a second end, with the first end supported by the handle bar of the bicycle and secured to the ground, wherein the connecting device comprises two pads formed on a lower portion of the connecting device with the pads engaging the ground, with the pads connected to the pseudo shaft.

8. The tent according to claim 7 wherein the pseudo shaft defines a hole for receiving a quick-release device for retaining the front fork on the pseudo shaft.

9. The tent according to claim 7 with the bicycle further including a front wheel removably received in the front fork and opposite to the handle bar, with the tent further comprising a peg, with the peg in the shape of a U to engage the front wheel disengaged from the front fork with the second end of the tent engaging the wheel stabilized by the peg and stabilized to the ground to hold the second end of the tent.

10. A tent for securing to ground comprising:

a cloth comprising a first end secured to the ground and a second end secured to the ground; and means for stabilizing a wheel in a vertical position with the second end of the cloth abutting the wheel and spaced from the ground, wherein the means for stabilizing the wheel has at least one leg for insertion into the ground and at least one crossbar extending from the leg and abutting the wheel.

11. The tent according to claim 10 wherein the cloth comprises a cover extending from the second end of the cloth with the front wheel located between the second end of the cloth and the cover.

12. The tent according to claim 11 comprising at least one zipper connecting the second end of the cloth with the cover.

13. The tent according to claim 11 wherein the cloth comprises an auxiliary element extending from the cover, with the auxiliary element connected to the ground by at least one rope.

14. The tent according to claim 10 wherein the cloth comprises an auxiliary element extending from the second end of the cloth, with the auxiliary element connected to the ground.

15. The tent according to claim 10 wherein the cloth comprises an auxiliary element extending from the first end of the cloth, with the auxiliary element connected to the ground.

16. The tent according to claim 10 further comprising another means for stabilizing another wheel in a vertical position with the first end of the cloth abutting the other wheel and spaced from the ground.

17. The tent according to claim 16 wherein the cloth comprises a cover extending from each of the first and second ends with each of the wheels located between each of the first and second ends and the cover extending therefrom.

18. The tent according to claim 17 comprising at least one zipper connecting each of the first and second ends of the cloth with each cover.

19. The tent according to claim 16 wherein the cloth comprises an auxiliary element extending from each of the first and second ends, with the auxiliary element connected to the ground.

20. The tent according to claim 16 wherein the cloth comprises a single portion.

21. The tent according to claim 16 wherein the cloth comprises several portions made separately and connected with one another by at least one zipper.

22. The tent according to claim 10 wherein the means for stabilizing the wheel is in a shape of a U.

* * * * *